US006389825B1

(12) United States Patent
Wightman

(10) Patent No.: US 6,389,825 B1
(45) Date of Patent: May 21, 2002

(54) EVAPORATOR COIL WITH MULTIPLE ORIFICES

(75) Inventor: David A. Wightman, Prospect Heights, IL (US)

(73) Assignee: XDX, LLC, Arlington Heights, IL (US)

( * ) Notice: Subject to any disclaimer, the term of this patent is extended or adjusted under 35 U.S.C. 154(b) by 0 days.

(21) Appl. No.: 09/661,478

(22) Filed: Sep. 14, 2000

(51) Int. Cl.[7] ..... F25B 41/00; F28F 7/00

(52) U.S. Cl. ..... 62/117; 62/525; 165/139; 165/297

(58) Field of Search ..... 62/199, 198, 117, 62/519, 525, 263; 165/139, 297

(56) References Cited

U.S. PATENT DOCUMENTS

| | | | | |
|---|---|---|---|---|
| 1,907,885 A | * | 5/1933 | Shively | 62/263 X |
| 2,112,039 A | | 3/1938 | McLenegan | |
| 2,467,519 A | * | 4/1949 | Borghesan | 165/297 X |
| 2,596,036 A | | 5/1952 | MacDougall | |
| 2,707,868 A | | 5/1955 | Goodman | |
| 2,944,411 A | | 7/1960 | McGrath | 62/196 |
| 2,960,845 A | | 11/1960 | Lange | 62/205 |
| 3,007,681 A | * | 11/1961 | Keller | 165/139 X |
| 3,257,822 A | | 6/1966 | Abbott | 62/428 |
| 3,727,423 A | | 4/1973 | Nielson | 62/205 |
| 3,792,594 A | | 2/1974 | Kramer | 62/503 |
| 3,965,693 A | | 6/1976 | Widdowson | 62/217 |
| 4,543,802 A | | 10/1985 | Ingelmann et al. | 62/525 |
| 4,606,198 A | | 8/1986 | Latshaw et al. | 62/205 |
| 4,742,694 A | | 5/1988 | Yamanaka et al. | 62/510 |
| 5,195,331 A | | 3/1993 | Zimmerman et al. | 62/202 |
| 5,377,498 A | | 1/1995 | Cur et al. | 62/187 |
| 5,839,505 A | | 11/1998 | Ludwig et al. | 165/109.1 |
| 5,887,651 A | | 3/1999 | Meyer | 165/223 |
| 5,964,099 A | | 10/1999 | Kim | |
| 5,987,916 A | | 11/1999 | Egbert | |
| 6,318,118 B2 | | 11/2001 | Hanson et al. | 62/512 |

FOREIGN PATENT DOCUMENTS

| | | | |
|---|---|---|---|
| DE | 197 43 734 A1 | 4/1999 | F25B/1/00 |
| EP | 0355180 | 2/1990 | |
| EP | 0 355 180 A2 | 2/1990 | F25B/49/00 |
| JP | 58146778 | 9/1983 | F16K/17/38 |
| JP | 03020577 | 1/1991 | F28F/1/42 |
| JP | 10306958 | 11/1998 | F25B/41/00 |
| WO | WO 93/06422 | 4/1993 | F25B/41/00 |
| WO | WO 98/03827 | 1/1998 | F25B/39/04 |
| WO | WO 98/57104 | 12/1998 | F25B/41/06 |

OTHER PUBLICATIONS

Pending U.S. Patent Application Serial No. 09/228,696 entitled Vapor Compression System and Method filed Jan. 12, 1999 (our docket: 9713/3).

Pending U.S. Patent Application Serial No. 09/431,830 entitled Vapor Compression System and Method filed Nov. 2, 1999 (our docket: 9713/4).

(List continued on next page.)

*Primary Examiner*—William Wayner
(74) *Attorney, Agent, or Firm*—Brinks, Hofer, Gilson & Lione

(57) ABSTRACT

A vapor compression system including a compressor, a condenser, an expansion device, and an evaporator. The evaporator includes a main distributor having an inlet, a first outlet, and a second outlet, a coil, the coil having an inlet connected with the first outlet of the main distributor, an outlet, and at least one opening, wherein the opening is located on a surface of the coil between the inlet and the outlet, and a feed line connecting the second outlet of the main distributor to the coil opening. The vapor compression system includes a discharge line connecting the compressor to the condenser, a liquid line connecting the condenser to the inlet of the expansion device, a saturated vapor line connecting the outlet of the expansion device to the inlet of the main distributor, and a suction line connecting the outlet of the coil to the compressor.

18 Claims, 2 Drawing Sheets

OTHER PUBLICATIONS

Pending U.S. Patent Application Serial No. 09/443,071 entitled Vapor Compression System and Method filed Nov. 18, 1999 (our docket: 9713/5).

Pending International Application No. PCT/US00/00622 entitled Vapor Compression System and Method International Filing Date: Jan. 10, 2000 (our docket: 9713/7).

Pending International Application No. PCT/US00/00663 entitled Vapor Compression System and Method International Filing Date: Jan. 11, 2000 (our docket: 9713/8).

Pending International Application No. PCT/US00/14648 entitled Vapor Compression System and Method International Filing Date: May 26, 200 (our docket: 9713/14).

Pending U.S. Patent Application Serial No. 09/661,477 entitled Expansion Device for Vapor Compression System filed Sep. 14, 2000 (our docket: 9713/16).

Pending U.S. Patent Application Serial No. 09/661,543 entitled Vapor Compression System filed Sep. 14, 2000 (our docket: 9713/17).

* cited by examiner

EVAPORATOR COIL WITH MULTIPLE ORIFICES

BACKGROUND

This invention relates, in general, to vapor compression systems, and more particularly, to a vapor compression system having an evaporator with at least one feed line for flowing heat transfer fluid into a coil having multiple orifices.

In a closed-loop vapor Compression cycle, heat transfer fluid changes state from a vapor to a liquid in the condenser, giving off heat to ambient surroundings, and changes state from a liquid to a vapor in the evaporator, absorbing heat from the ambient surroundings during vaporization. A typical vapor compression system includes a compressor for pumping heat transfer fluid, such as a freon, to a condenser, where heat is given off as the heat transfer fluid condenses into a liquid. The heat transfer fluid then flows through a liquid line to an expansion device, where the heat transfer fluid undergoes a volumetric expansion. The expanded heat transfer fluid then flows into an evaporator. The evaporator includes a coil having an inlet and an outlet, wherein the heat transfer fluid is vaporized at a low pressure absorbing heat while it undergoes a change of state from a liquid to a vapor. The heat transfer fluid, now in the vapor state, flows through the coil outlet and exits the evaporator. Upon exiting the evaporator, the heat transfer fluid then flows through a suction line and back to the compressor.

In one aspect, the efficiency of the vapor compression cycle depends upon the time required to charge the evaporator, that is the time required to fill the coil within the evaporator with the heat transfer fluid. In general, vapor compression systems charge the evaporator by flowing heat transfer fluid through the coil inlet, through the length of the coil and out through the coil outlet. The heat transfer fluid fills the length of the coil all by entering through only one orifice, that is, the coil inlet. Charging the evaporator by forcing heat transfer fluid through only one orifice, the coil inlet, takes a substantial amount of time. Additionally, by locating that orifice at the entrance of the coil, the heat transfer fluid is forced to fill the coil in a direction from the coil inlet to the coil outlet. This causes the temperature of the coil surface surrounding coil inlet to become much cooler than the temperature of the coil surface surrounding the coil outlet, while the evaporator is charging. Since the temperature of the coil surface is not constant throughout the length of the coil, the evaporator may not absorb heat as efficiently from the ambient surroundings.

Accordingly, further development of vapor compression systems, and more specifically, vapor compression systems which charging an evaporator by forcing heat transfer fluid through only one orifice, is necessary in order to decrease the amount of time required to charge an evaporator and increase the efficiency of the evaporator.

SUMMARY

According to one aspect of the present invention, a vapor compression system is provided. The vapor compression system includes a compressor for increasing the pressure and temperature of a heat transfer fluid, a condenser for liquefying the heat transfer fluid, and an expansion device having an inlet and an outlet. The vapor compression system also includes an evaporator for transferring heat from ambient surroundings to the heat transfer fluid. The evaporator includes a main distributor having an inlet, a first outlet, and a second outlet, a coil, the coil having an inlet connected with the first outlet of the main distributor, an outlet, and at least one opening, wherein the opening is located on a surface of the coil between the inlet and the outlet, and a feed line connecting the second outlet of the main distributor to the coil opening. The vapor compression system includes a discharge line connecting the compressor to the condenser, a liquid line connecting the condenser to the inlet of the expansion device, a saturated vapor line connecting the outlet of the expansion device to the inlet of the main distributor, and a suction line connecting the outlet of the coil to the compressor.

According to another aspect of the present invention, a method for operating a vapor compression system is provided. The method includes, providing an evaporator for transferring heat from ambient surroundings to a heat transfer fluid, the evaporator comprising at least one coil, the coil having an inlet, an outlet, and at least one opening, wherein the opening is located on a surface of the coil between the inlet and the outlet, and flowing the heat transfer fluid through both the coil inlet and the coil opening.

According to yet another aspect of the present invention an evaporator for transferring heat from ambient surroundings to a heat transfer fluid is provided. The evaporator includes a main distributor for receiving heat transfer fluid, at least one coil, the coil having an inlet connected with a first outlet of the main distributor, an outlet, and at least one opening, wherein the opening is located on a surface of the coil between the inlet and the outlet of the coil, and a feed line connected with a second outlet of the main distributor and the coil opening.

Figure 1:
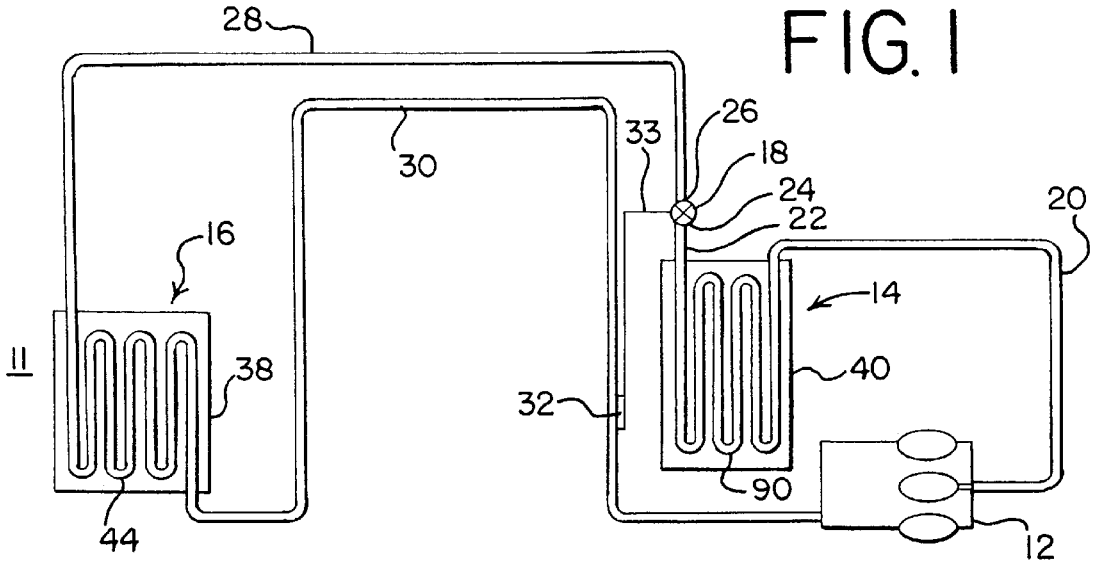
FIG. 1 is a schematic drawing of a vapor compression system arranged in accordance with one embodiment of the invention.

For simplicity and clarity of illustration, elements shown in the Figures have not necessarily been drawn to scale. For example, dimensions of some elements are exaggerated relative to each other. Further, when considered appropriate, reference numerals have been repeated among the Figures to indicate corresponding elements.

DETAILED DESCRIPTION OF THE PRESENTLY PREFERRED EMBODIMENTS

One embodiment of a vapor compression system 10 is illustrated in FIG. 1. Vapor compression system 10 includes a compressor 12, a condenser 14, an evaporator 16, and an expansion device 18. Compressor 12 is coupled to condenser 14 by a discharge line 20. Expansion device 18 is coupled to condenser 14 by a liquid line coupled to an inlet 24 of expansion device 18. In one embodiment, expansion device 18 is coupled to discharge line 20 at a second inlet (not shown). A saturated vapor line 28 couples outlet 26 of expansion device 18 to evaporator 16, and a suction line 30 couples the outlet of evaporator 16 to the inlet of compressor 12. Preferably, a sensor 32 is mounted to suction line 30 and is operably connected to expansion device 18. Sensor 32 can be any type of sensor known by those skilled in the art designed to detect conditions of heat transfer fluid 34 such as temperature, pressure, enthalpy, moisture or any other type of conditions that may be monitored. For example, sensor 32 may be a pressure sensor that detect the pressure of heat transfer fluid 34 at a certain point within vapor compression system 10, or a temperature sensor which detect the temperature of heat transfer fluid 34 at a certain point within vapor compression system 10. Preferably, sensor 32 relays information about the conditions of heat transfer fluid 34 at a certain point along vapor compression system 10, such a pressure and temperature, through control line 33 to expansion device 18. Sensor 32 may relay information about the conditions of heat transfer fluid 34 using other devices, such as wireless transmitters and receivers.

Vapor compression system 10 can utilize essentially any commercially available heat transfer fluid 34 including refrigerants such as, for example, chlorofluorocarbons such as R-12 which is a dicholordifluoromethane, R-22 which is a monochlorodifluoromethane, R-500 which is an azeotropic refrigerant consisting of R-12 and R-152a, R-503 which is an azeotropic refrigerant consisting of R-23 and R-13, and R-502 which is an azeotropic refrigerant consisting of R-22 and R-115. Vapor compression system 10 can also utilize heat transfer fluids 34 including, but not limited to, refrigerants R-13, R-113, 141b, 123a, 123, R-114, and R-11. Additionally, vapor compression system 10 can utilize heat transfer fluids 34 including hydrochlorofluorocarbons such as 141b, 123a, 123, and 124; hydrofluorocarbons such as R-134a, 134, 152, 143a, 125, 32, 23; azeotropic HFCs such as AZ-20 and AZ-50 (which is commonly known as R-507); and blended refrigerants such as MP-39, HP-80, FC-14, R-717, and HP-62 (commonly known as R-404a). Accordingly, it should be appreciated that the particular heat transfer fluid 34 or combination of heat transfer fluid 34 utilized in the present invention is not deemed to be critical to the operation of the present invention since this invention is expected to operate with a greater system efficiency with virtually all heat transfer fluids 34 than is achievable by any previously known vapor compression system utilizing the same heat transfer fluid 34.

In operation, compressor 12 compresses heat transfer fluid 34, to a relatively high pressure and temperature. The temperature and pressure to which heat transfer fluid 34 is compressed by compressor 12 will depend upon the particular size of vapor compression system 10 and the cooling load requirements of vapor compression system 10. Compressor 12 pumps heat transfer fluid 34 into discharge line 20 and into condenser 14.

In condenser 14, a medium such as air, water, or a secondary refrigerant is blown past coils within condenser 14 causing the pressurized heat transfer fluid 34 to change to a liquid state. The temperature of the heat transfer fluid 34 drops as the latent heat within the heat transfer fluids 34 is expelled during the condensation process. Condenser 14 discharges the liquefied heat transfer fluid 34 to liquid line 22.

As shown in FIG. 1, liquid line 22 discharges into expansion device 18. Expansion device 18 may be any device, know known or later developed, that can be used to meter the flow of heat transfer fluid 34. Expansion device 18 includes, but is not limited to, a thermostatic expansion valve, a capillary tube, and a pressure control. The heat transfer fluid 34 discharged by condenser 14 enters expansion device 18 at inlet 24 and undergoes a volumetric expansion. In one embodiment, heat transfer fluid 34 discharged by condenser 14 enters expansion device 18 at inlet 24 and undergoes a volumetric expansion at a rate determined by the conditions of suction line 30, such as the temperature and pressure at sensor 32. Sensor 32 relays information about the conditions of suction line, such a pressure and temperature, through control line 33 to expansion device 18. Upon undergoing a volumetric expansion, expansion device 18 discharges the heat transfer fluid 34 as a saturated vapor into saturated vapor line 28. Saturated vapor line 28 connects the outlet 26 of expansion device 18 with the inlet of the evaporator 16, and more particularly, with an inlet 63 of a main distributor 62 within evaporator 16.

Figure 2:
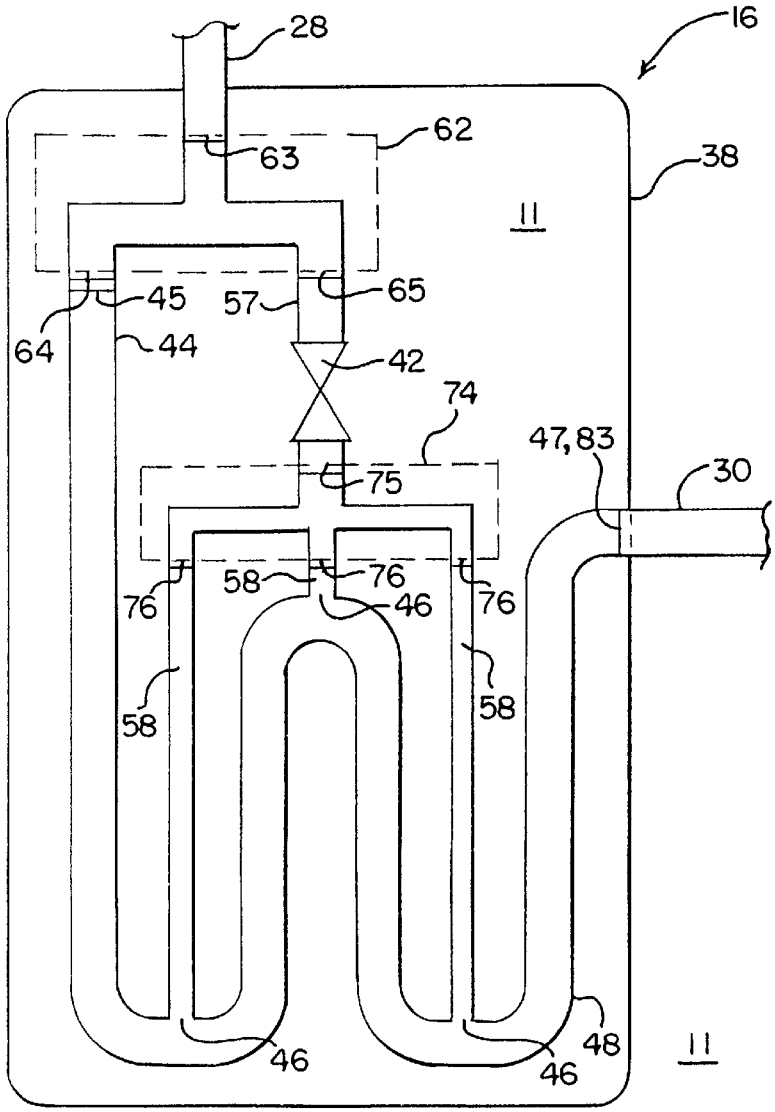
FIG. 2 is a schematic view of an evaporator, in accordance with one embodiment of the invention.
Figure 3:
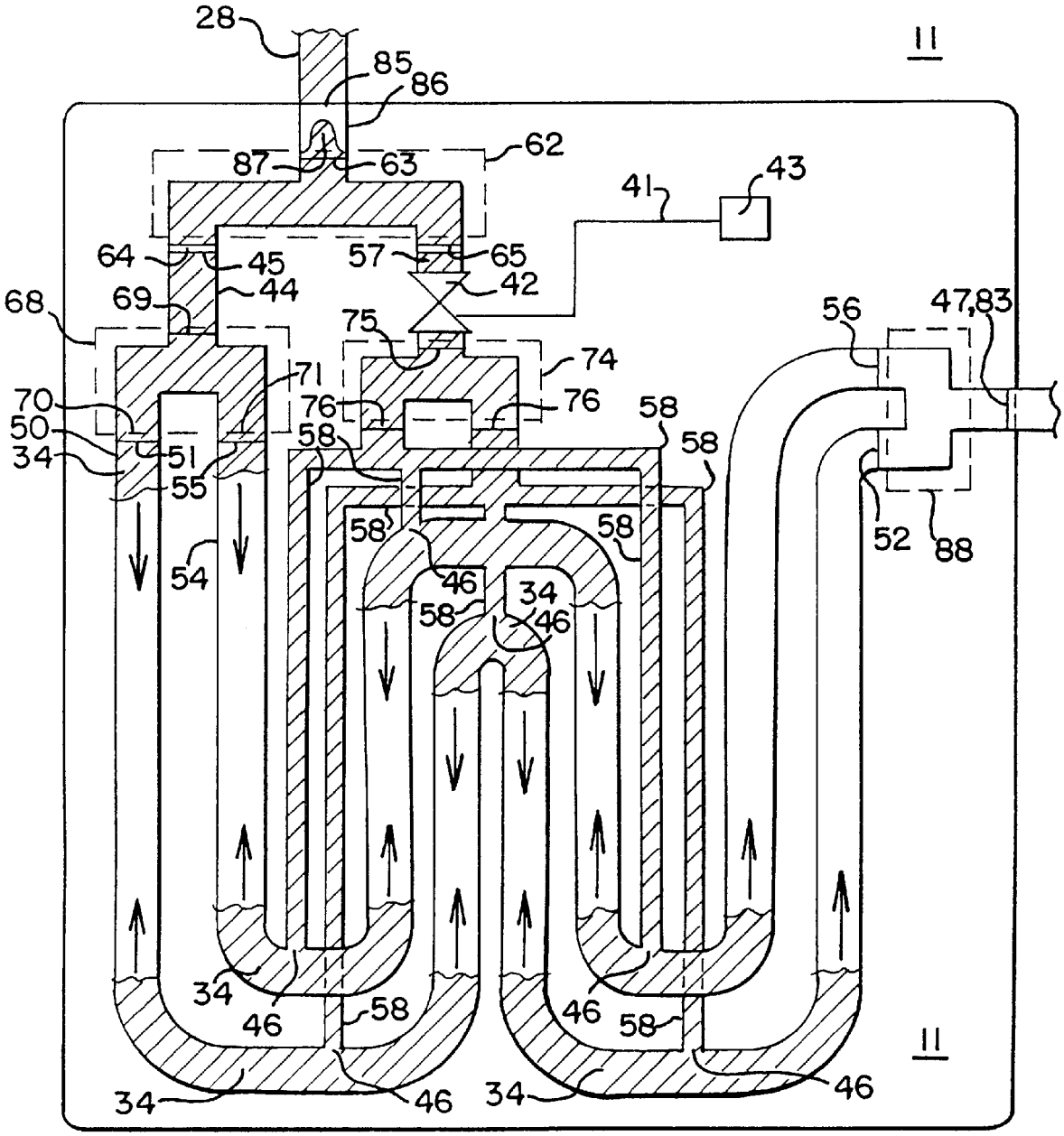
FIG. 3 is a cross-sectional schematic view of an evaporator, in accordance with one embodiment of the invention.

Shown in FIG. 2 is a schematic view of evaporator 16 for transferring heat from the ambient surroundings 11 to heat transfer fluid 34, in accordance with one embodiment of the invention. Ambient surroundings 11 is the atmosphere surrounding evaporator 16 and coils 44, as illustrated in FIGS. 1–3. Evaporator 16 includes a main distributor 62, a coil 44, and a feed line 58. Main distributor 62 includes an inlet 63 connected with the outlet 26 of expansion device 18 through saturated vapor line 28, and at least two outlets 64, 65, as illustrated in FIG. 2. Coil 44 includes an inlet 45, an outlet 47, an opening 46, and a surface 48. Inlet 45 of coil 44 is connected with the first outlet 64 of main distributor 62 and the outlet of coil 44 is connected with outlet 83 of evaporator 16, as illustrated in FIG. 2. Coil 44 is generally tubular in shape and has a surface 48 surrounding coil 44, as illustrated in FIG. 2. Opening 46 of coil 44 is located on the surface 48 of coil 44 between the inlet 45 and the outlet 47 of coil 44. Coil 44 is surrounded by evaporator housing 38. The developed length of coil 44 from the inlet 45 to the outlet 47 of coil 44 is herein referred to as the length L of coil 44. Feed line 58 connects the second outlet 65 of main distributor 62 with opening 46 of coil 44.

In operation, heat transfer fluid 34 enters inlet 63 of main distributor 62 and traverses through main distributor 62 to the first outlet 64 and second outlet 65 of main distributor 62. Heat transfer fluid 34 exits main distributor 62 through first outlet 64 to inlet 45 of coil 44, and traverses through the length L of coil 44 to outlet 47 of coil 44. When charging coil 44 of evaporator 16, heat transfer fluid 34 also exits main distributor 62 through second outlet 65, through feed line 58, and into opening 46 of coil 44. Preferably, a gating valve 42 is positioned in feed line 58 near second inlet 65 to control the flow of heat transfer fluid through opening 46. Gating valve 42 is capable of terminating the flow of the heat transfer fluid through feed line 58. Preferably, gating valve 42 is a solenoid valve capable of terminating the flow of heat transfer fluid through a passageway, such as feed line 58, in response to an electrical signal. However, gating valve 42 may be any valve capable of terminating the flow of heat transfer fluid through a passageway known to one of ordinary skill, such as a valve that is mechanically activated. When charging coil 44 of evaporator 16, gating valve 42 is opened to allow heat transfer fluid 34 to flow through feed line 58, through opening 46, and into coil 44. Preferably, opening 46 is located on the surface 48 of the coil 44 between one-third and two-thirds of the way down the length L of the coil 44, wherein the length L of the coil 44 begins at inlet 45 and ends at outlet 47. By placing opening 46 between one-third and two-thirds of the way down the length L of the coil 44, heat transfer fluid 34 is able to enter and fill different areas of the coil 44 simultaneously, thus allowing for a more rapid charging of evaporator 16. Additionally, by filling different areas of coil 44 simultaneously, the temperature of coil 44 throughout the length of coil 44 is more constant than in a conventional vapor compression system.

In one embodiment, coil 44 in evaporator 16 includes multiple circuits 50, 54 through evaporator 16, as illustrated in FIG. 3. As used herein, circuits are portions of the coil 44 used to flow the heat transfer fluid 34 multiple times through evaporator 16. Preferably, evaporator 16 includes a circuit distributor 68 to divides the flow of heat transfer fluid 34 into at least a first circuit 50 and second circuit 54, wherein the inlet 69 of circuit distributor 68 is connected with If the first outlet 64 of main distributor, and the outlets 70, 71 of circuit distributor 68 are connected with the inlets 51, 55 of circuits 50, 54, respectively. However, evaporator 16 may use main distributor 62, or any other type of distributor, to divide the flow of heat transfer fluid 34 into multiple circuits of coil 44. Preferably, evaporator 16 includes a collector manifold 88 to combine the flow of heat transfer fluid 34 exiting from multiple circuits, such as first circuit 50 and second circuit 54, as illustrated in FIG. 3.

If evaporator 16 includes multiple circuits, such as circuits 50, 54, opening 46 is located on a surface of at least one of circuits 50, 54 between the inlets 51, 55 and the outlets 52, 56 of circuits 50, 54. Preferably, at least one opening 46 is located on a surface of each circuit 50, 54 between the inlet and the outlet of each circuit 50, 54. For example, if evaporator 16 includes first circuit 50 and second circuit 54, evaporator 16 preferably includes at least one opening 46 located an a surface of first circuit 50 between inlet 51 and outlet 52 of first circuit 50 and at least one opening 46 is located on a surface of second circuit 54 between inlet 55 and outlet 56 of second circuit 54.

In one embodiment, coil 44 of evaporator 16 includes multiple openings 46 on the surface 48 of coil 44 between inlet 45 and outlet 46 of coil 44, as illustrated in FIGS. 2–3. Coil 44 may contain any number of openings 46 on the surface 48 of coil 44 between inlet 45 and outlet 46 of coil 44 so as to allow heat transfer fluid to enter and fill coil 44 at number of locations along the length L of coil 44. The more openings 46 that are placed one the surface 48 of the coil 44, the more rapidly the evaporator 16 may be charged. Additionally, the more areas of the coil 44 that are filled, simultaneously, the more constant the temperature of the surface 48 of coil 44 throughout the length of coil 44 can remain.

Each opening 46 is connected with at least one outlet of the main distributor 62 through a feed line 58, as illustrated in FIG. 3. In one embodiment, evaporator 16 includes a main feed line 57 connected with the second outlet 65 of main distributor 62, as illustrated in FIGS. 2–3. Main feed line 57 connects the second outlet 65 of main distributor 62 with an inlet 75 of a feed line distributor 74. Feed line distributor 74 includes multiple outlets 76, 77 connected with all feed lines 58 and all openings 46. Preferably, evaporator 16 has at least one gating valve 42 positioned in feed line 58 and/or main feed line 57 in order to control the flow of heat transfer fluid 34 through openings 46. Gating valve 42 is capable of terminating the flow of the heat transfer fluid through any feed line 57, 58 in which gating valves 42 is positioned in. In one embodiment, a single gating valve 42 is positioned in main feed line 57 and is capable of terminating the flow of heat transfer fluid 34 through all feed lines 57, 58. In one embodiment, multiple gating valves 42 are positioned in multiple feed lines 57, 58 and are capable of selectively terminating the flow of heat transfer fluid 34 in any one opening 46.

In one embodiment, a control line 41 is connected with a sensor 43 to at least one gating valve 42 for controlling the flow of heat transfer fluid 34 through opening 46 in response to a condition. Sensor 43 may be mounted to coil 44 or within ambient surroundings 11. Sensor 43 can be any type of sensor known by those skilled in the art designed to detect conditions such as temperature, pressure, enthalpy, moisture or any other type of conditions that may be monitored. For example, sensor 43 may be a pressure sensor that detects the pressure of heat transfer fluid 34, coil 44, or ambient surroundings 11 at a certain point in or around vapor compression system 10. Sensor 43 may also be a temperature sensor that detects the temperature of heat transfer fluid 34, coil 44, or ambient surroundings 11 at a certain point in or around vapor compression system 10. Sensor 43 relays information about the conditions of heat transfer fluid 34, coil 44, or ambient surroundings 11 through control line 41 to gating valve 42. Sensor 43 may relay information about the conditions of heat transfer fluid 34, coil 44, or ambient surroundings 11 using other devices, such as wireless transmitters and receivers. Multiple sensors 43 may be mounted to coil 44 or within ambient surroundings 11 in order to detect multiple conditions and relay such information to multiple gating valves 42. While the above use of sensor 43 to control the flow of heat transfer fluid 34 through opening 46 has been described as being in response to conditions such as temperature, pressure, enthalpy, and moisture, sensor 43 may control the flow of heat transfer fluid 34 through opening 46 in response to any variable or condition.

In one embodiment, evaporator 16 includes a nozzle 86 for expanding heat transfer fluid before entering main distributor 62. Nozzle 86 can be any type of nozzle, orifice, or device known by those skilled in the art designed to expand fluid, such as heat transfer fluid 34. Nozzle 86 includes an inlet 85 connected with saturated vapor line 28 and an outlet 87 connected with the inlet 63 of the main distributor 62.

While the above embodiments have been described with respect to evaporator 16, the idea of using a feed line to simultaneously feed fluid into multiple portions of a coil may be applied to other coils, such as coil 90 within condenser 14. In one embodiment, condenser 14 includes a coil 90 having an inlet and an outlet. Coil 90 may include an opening, such as opening 46, wherein the opening is located on a surface of coil 90 between the inlet and the outlet of coil 90. Condenser 14 may also include a distributor, such as main distributor 62, and a feed line, such as feed line 58, wherein the distributor of the condenser 14 is connected with the inlet of the condenser 14, the feed line of the condenser 14, and coil 90, and wherein the feed line of the condenser 14 is connected with the opening of the condenser 14.

Moreover, while in the above described embodiments main distributor 62 includes a first outlet 52 and a second outlet 56, main distributor 62 may have multiple outlets connected to multiple feed lines 57, 58 and multiple circuits 50, 54 of coil 44. Moreover, while in the above described embodiments, evaporator 16 includes circuit distributor 68 for dividing the flow of heat transfer fluid 34 into first circuit 50 and second circuit 54, and a feed line distributor 74 for dividing the flow of heat transfer fluid 34 from main feed line 57 amongst multiple feed lines 58, evaporator 16 may include any number of distributors, or combination of distributors, to divide the flow of heat transfer fluid 34 into multiple circuits 50, 54 and multiple feed lines 58. Additionally, vapor compression system 10 may include a single distributor, such as main distributor 62, with multiple outlets for dividing the flow of heat transfer fluid 34 into a coil 44 having at least one circuit 50, 54 and into at least one feed line 57, 58.

While in the above embodiments, evaporator 16 includes only two circuits 50, 54, evaporator 16 may have more than two circuits 50, 54. Additionally, while in the above embodiments, coil 44 and/or circuits 50, 54 have been described as having only one opening 46, coil 44 and/or circuits 50, 54 may have more than one opening 46.

Those skilled in the art will appreciate that numerous modifications can be made to enable vapor compression system 10 to address a variety of applications. For example, vapor compression system 10 operating in a retail food outlet may include a number of evaporators 16 that can be serviced by a common compressor 12. Also, in applications requiring refrigeration operations with high thermal loads, multiple compressors 12 can be used to increase the cooling capacity of the vapor compression system 10.

Those skilled in the art will recognize that vapor compression system 10 can be implemented in a variety of configurations. For example, the compressor 12, condenser 14, expansion device 18, and the evaporator 16 can all be housed in a single housing and placed in a walk-in cooler. In this application, the condenser 14 protrudes through the wall of the walk-in cooler and ambient air outside the cooler is used to condense the heat transfer fluid 34. In another application, vapor compression system 10 can be configured for air-conditioning a home or business. In yet another application, vapor compression system 10 can be used to chill water. In this application, the evaporator 16 is immersed in water to be chilled. Alternatively, water can be pumped through tubes that are meshed with the evaporator coil 44. In a further application, vapor compression system 10 can be cascaded together with another system for achieving extremely low refrigeration temperatures. For example, two vapor compression systems using different heat transfer fluids 34 can be coupled together such that the evaporator of a first system provides a low temperature ambient. A condenser of the second system is placed in the low temperature ambient and is used to condense the heat transfer fluid in the second system.

As known by one of ordinary skill in the art, every element of vapor compression system 10 described above, such as evaporator 16, liquid line 22, and suction line 30, can be scaled and sized to meet a variety of load requirements. In addition, the refrigerant charge of the heat transfer fluid in vapor compression system 10, may be equal to or greater than the refrigerant charge of a conventional system.

Thus, it is apparent that there has been provided, in accordance with the invention, a vapor compression system that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, non-halogenated refrigerants can be used, such as ammonia, and the like can also be used. It is therefore intended to include within the invention all such variations and modifications that fall within the scope of the appended claims and equivalents thereof.

What is claimed is:

1. A vapor compression system comprising:

a compressor;

a condenser;

an expansion device;

an evaporator comprising:

a coil having an inlet connected with the first outlet of the main distributor, an outlet, a circuit distributor for dividing the flow of heat transfer fluid into a first circuit and a second circuit, the circuit distributor having an inlet connected with the first outlet of the main distributor, and at least one opening, wherein the opening is located on a surface of the coil between the inlet and the outlet; and a feed line connecting the second outlet of the main distributor to the coil opening;

a discharge line connecting the compressor to the condenser;

a liquid line connecting the condenser to the expansion device;

a saturated vapor line connecting the expansion device to the inlet of the main distributor; and a suction line connecting the outlet of the coil to the compressor.

2. The vapor compression system of claim 1, further comprising a sensor mounted to the suction line and operatively connected to the expansion device.

3. The vapor compression system of claim 1, wherein the coil opening is located on the surface of the coil between one-third and two-thirds of the way down the length of the coil.

4. The vapor compression system of claim 1, further comprising a gating valve connected with the second outlet of the main distributor for controlling the flow of heat transfer fluid through the opening of the coil.

5. The vapor compression system of claim 1 further comprising a sensor for monitoring the conditions of the ambient surroundings.

6. The vapor compression system of claim 5 further comprising a gating valve connected with the second outlet of the main distributor for controlling the flow of heat transfer fluid to the coil opening, wherein the sensor is operatively connected to the gating valve.

7. The vapor compression system of claim 6, wherein the first gating valve controls the flow of heat transfer fluid through the coil opening upon receiving a signal from the sensor.

8. The vapor compression system of claim 1 further comprising:

a plurality of evaporators;

a plurality of expansion devices;

a plurality of saturated vapor lines, wherein each saturated vapor line connects one of the plurality of expansion devices to one of the plurality of evaporators;

a plurality of suction lines, wherein each suction line connects one of the plurality of evaporators to the compressor, wherein each of the plurality of suction lines has a sensor mounted thereto for relaying a signal to a selected one of the plurality of expansion devices.

9. A vapor compression system comprising:

a compressor;

a condenser;

an expansion device;

an evaporator comprising:

a main distributor having an inlet, a first outlet, and a second outlet;

a coil having an inlet connected with the first outlet of the main distributor, an outlet, and at least one opening, wherein the opening is located on a surface of the coil between the inlet and the outlet; and a feed line connecting the second outlet of the main distributor to the coil opening;

a discharge line connecting the compressor to the condenser;

a liquid line connecting the condenser to the expansion device;

a saturated vapor line connecting the expansion device to the inlet of the main distributor;

a suction line connecting the outlet of the coil to the compressor; and a nozzle for expanding heat transfer fluid, the nozzle having an inlet connected with the saturated vapor line and an outlet connected with the inlet of the main distributor.

10. A method for operating a vapor compression system comprising:

providing an evaporator for transferring heat from ambient surroundings to a heat transfer fluid, the evaporator comprising at least one coil, the coil having an inlet, an outlet, multiple circuits, and at least one opening, wherein the opening is located on a surface of the coil between the inlet and the outlet; and flowing the heat transfer fluid through both the coil inlet and the coil opening.

11. The method of claim 10 wherein the evaporator further comprises a gating valve for controlling the flow of heat transfer fluid through the coil opening.

12. The method of claim 10, wherein the heat transfer fluid flows simultaneously through both the coil inlet and the coil opening.

13. An evaporator for transferring heat from ambient surroundings to a heat transfer fluid, the evaporator comprising:

a main distributor for receiving heat transfer fluid;

at least one coil, the coil having an inlet connected with a first outlet of the main distributor, an outlet, multiple circuits and at least one opening, wherein the opening is located on a surface of the coil between the inlet and the outlet of the coil; and a feed line connected with a second outlet of the main distributor and the coil opening.

14. The evaporator of claim 13 further comprising a gating valve positioned adjacent to the coil opening for controlling the flow of heat transfer fluid through the coil opening.

15. The evaporator of claim 14 further comprising a sensor for controlling the flow of heat transfer fluid through the coil opening in response to a condition.

16. The evaporator of claim 13, wherein the coil opening is located on the surface of the coil between one-third and two-thirds of the way down the length of the coil.

17. The evaporator of claim 13, wherein the coil opening is located on the surface of the coil between one-tenth and nine-tenths of the way down the length of the coil.

18. The evaporator of claim 13, further comprising multiple feed lines, wherein the coil has multiple openings located on the surface of the coil between the inlet and the outlet of the coil, and wherein the multiple feed lines are connected with the second outlet of the main distributor and the multiple coil openings.

* * * * *

UNITED STATES PATENT AND TRADEMARK OFFICE

CERTIFICATE OF CORRECTION

PATENT NO. : 6,389,825 B1
DATED : May 21, 2002
INVENTOR(S) : David A. Wightman

It is certified that error appears in the above-identified patent and that said Letters Patent is hereby corrected as shown below:

Title page,
Item [56], References Cited, OTHER PUBLICATIONS, "Pending International Application No. PCT/US00/14648" reference, after "May 26," delete "200" and substitute -- 2000 -- in its place.

Column 7,
Line 63, insert a new paragraph:
-- a main distributor having an inlet, a first outlet, and a second outlet; --.

Signed and Sealed this

Twenty-fifth Day of May, 2004

JON W. DUDAS
*Acting Director of the United States Patent and Trademark Office*